United States Patent [19]

Sahm

[11] Patent Number: 4,754,977

[45] Date of Patent: Jul. 5, 1988

[54] GOLF CLUB

[75] Inventor: Douglas Sahm, Encinitas, Calif.

[73] Assignee: Players Golf, Inc., Solano Beach, Calif.

[21] Appl. No.: 874,682

[22] Filed: Jun. 16, 1986

[51] Int. Cl.[4] ..... A63B 53/04

[52] U.S. Cl. ..... 273/171; 273/167 A

[58] Field of Search ..... 273/171, 169, 170, 172, 273/167 F, 167 H

[56] References Cited

U.S. PATENT DOCUMENTS

| | | | |
|---|---|---|---|
| 1,133,129 | 3/1915 | Govan | 273/171 |
| 2,360,364 | 10/1944 | Reach | 273/17 |
| 3,556,533 | 1/1971 | Hollis | 273/171 |
| 3,582,081 | 6/1971 | Caplan | 273/171 |
| 4,325,553 | 4/1982 | Taylor | 273/171 |
| 4,423,874 | 1/1984 | Stuff | 273/171 |

FOREIGN PATENT DOCUMENTS

| | | | |
|---|---|---|---|
| 440379 | 12/1935 | United Kingdom | 273/171 |
| 2145629 | 4/1985 | United Kingdom | 273/171 |

*Primary Examiner*—George J. Marlo

*Attorney, Agent, or Firm*—James Creighton Wray

[57] ABSTRACT

A golf club head is provided with sockets generally opposite the club face. The sockets receive removable and interchangeable weights fabricated from materials of varying density. Weighting changes can easily be effected by removing an existing set of weights and replacing them with a set made of greater or lesser density material. Preferably, the weights are screw-threaded into the sockets. A back side of the club head is hollowed in order to concentrate weight at the lowest possible point.

3 Claims, 2 Drawing Sheets

GOLF CLUB

BACKGROUND OF THE INVENTION

The present invention relates generally to sporting equipment and more specifically to the sport of golf.

Golf clubs have for many years been characterized as having hosel, heel, toe, face and flange portions. The hosel is generally a recepticle for receiving the club shaft and a support for generally supporting the club head on the end of the shaft. While one end of the hosel receives the club shaft, the other is integrally formed with the club head.

The club face is generally inclined at an angle depending on the required loft of the shot, and the flange is a generally flat surface on which the club rests prior to swinging the golf club.

Over the years, improvements in club design have focused on broadening flange, the purpose of which was to put more weight directly behind the ball at the area of impact. It was believed that the broadened flange would also allow the golfer to add more loft to his or her shots since more weight would be passing under the ball at impact.

Some golf club manufacturers provide permanent weights in club heads to customize the club with respect to an individual golf swing. In some instances, these permanent weights are provided in the heel and toe portions of the club head in an attempt to broaden the "sweet spot". The sweet spot is generally a center of gravity or point at which the ball impacts for optimal distance, trajectory and accuracy.

Problems persist in the art. An individual's golf swing may vary slightly or dramatically from week to week. While variances may occur, the golfer is limited to the permanent weighting of his or her clubs which were selected based on his or her swing at a given point in time. Moreover, a set of clubs customized for one golfer, cannot be used by another. The strength of a golfer may have profound effects on his or her swing. As strength changes, weighting of the club should also change.

SUMMARY OF THE INVENTION

The present invention solves many of the problems associated with the art of providing removable and interchangeable weights that can not only customize and optimize the weighting of a club for a given golfer, but can also allow the golfer to change weighting as his swing changes or as his strength changes.

The focus of the invention is on providing removable weights. One set of weights may be made of brass, while another set may be made of plastic, such that lighter or heavier weights can be used according to the needs of the golfer. Preferably, an entire spectrum of weights are used ranging from light to heavy with gradations there between. Conceivably, lead would provide a heavy weight, while wood or low density plastic would provide a light weight. Intermediate weights may be used to provide a gradual increment in density and therefore weighting.

Generally, a set of plastic weights could be substituted for a set of brass or other metal weights. In a preferred embodiment, the weights number three, with one in each of the toe and heel portions, and one in the middle approximately at the point of impact between the club face and the golf ball. While whole sets of three weights may be exchanged, it is possible to mix sets such that, for instance, light weights may be used in the heel and toe which a heavier weight may be used in the middle.

In spite of possible gains in the sweet spot by putting weights in the heel and toe portions, the present invention contemplates a central weight at the point of impact to maximize ball distance.

Uniquely, the present invention focuses weight of the club head at the three critical areas of the toe and heel and the point of impact (middle). This is achieved by hollowing out the back side of the club opposite the face and above the flange, and integrally forming three sockets immediately above the flange.

For irons, it is preferable to have the sockets disposed in line with the direction of the club swing, or in other words, in line with the intended flight direction of the ball.

For woods, it is preferable to have the sockets turned ninety degrees from the irons such that the sockets extend into the bottom of the club head through the flange. Although the general disposition of the sockets is different, it is still preferable to have three sockets, one in the heel and toe portions and one approximately at the point of impact.

This invention also contemplates use for golf putters, wherein the disposition of the sockets is similar to that of the irons, except that the sockets are approximately at a longitudinal axis of the club face and not at the flange.

An object of the invention is to provide a golf club apparatus having integrally formed hosel, heel, toe, face and flange portions, and weighting means, the weighting means comprising removable and interchangeable weighting means.

In a preferred embodiment, the weight means comprises weight recepticle means removable weights receivable in the weight recepticle means.

In another embodiment, the weight recepticle means are disposed above the flange portion and opposite the face portion.

In another embodiment, the weight recepticle means comprise sockets integrally formed with the flange portion opposite the face portion.

In another embodiment, the sockets are three equidistantly spaced sockets with one being disposed in the heel and toe portions respectively and one socket being disposed between the heel and toe portions.

In another embodiment, the invention further comprises fastening means for fastening the weights within the weight recepticle means.

In another embodiment, the weight recepticle means comprise sockets integrally formed with the flange portion opposite the face portion and the fastening means comprise tapped bores of the sockets meshing with threads provided on outer surfaces of the weights.

In another embodiment, the invention comprises means for removing and inserting weights.

In another embodiment, the means for removing and inserting comprises grooves provided in head portions of the weights.

In another embodiment, the sockets are three sockets, one being disposed in the heel and toe portions respectively and one socket being disposed between the heel and toe portions, and wherein longitudinal axes of the sockets are disposed in line with a swing direction of the club and are approximately aligned.

In another embodiment, the sockets have an outer peripheral edge coextensive with an outer edge of the flange portion.

In another embodiment, a back portion of the club opposite the face and above the flange portions is hollowed and wherein portions between the sockets are hollowed, wherein the hollowed portion provides for weight focus in an area of the sockets.

In another embodiment, the weights comprise plural sets of weights, each set being made of a material having a mass different from the material of the other sets.

In another embodiment, each set of weights comprises three weights, each being provided with threads engageable with threads provided in the weight receptacle.

In another embodiment, the material used in fabricating each set of weights is selected from a group consisting brass, plastic, steel, stainless steel, lead, wood and copper.

In another embodiment, the invention comprises a weighting system for clubs having hosel, heel, toe, face and flange portions. The weighting system comprising, weight receiving sockets and removable and interchangeable weights receivable in the sockets.

In another embodiment, the sockets are three equidistantly spaced sockets, one being disposed in the heel and toe portions, respectively, and being disposed between the other two sockets.

In another embodiment, the weights have screw-threaded outer surfaces engageable with screw threaded inner surfaces of the sockets, and wherein the weights have grooves provided in headed portions thereof, each weight having the same density as the other weights.

In another embodiment, three weights comprise a set, each set being interchangeable with sets having varying density.

In another embodiment, the sockets are disposed with longitudinal axes in a swing direction of the club.

In another embodiment, the sockets are disposed with longitudinal axes perpendicular to a swing direction of the club.

In another embodiment, the sockets are disposed at the flange portion, and wherein the club is hollowed between the sockets and opposite the face portion.

In another embodiment, the sockets extend into the flange portion.

In another embodiment, the sockets are disposed opposite the face portion approximately at a longitudinal axis of the face portion.

In another embodiment, the middle weight is disposed opposite a point of impact between a golf ball and the club face.

In another embodiment, the invention comprises a method for adjusting the weighting of a golf club having hosel, heel, toe, face and flange portions. The method comprises removing weights from sockets disposed opposite the face portion and substituting weights having a different density from the removed weights, and further substituting weights of different density until club weighting is optimized for an individual golfer.

In another embodiment, the invention comprises forming a club head with hollowed portions opposite the face portion and above the flange portion and between the sockets, thereby focusing weight at the sockets.

DETAILED DESCRIPTION OF THE DRAWINGS

Figure 1:
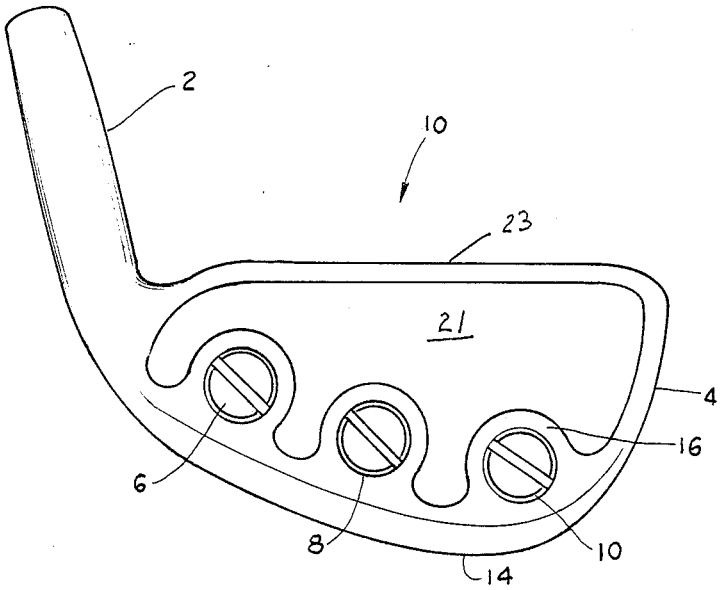
FIG. 1 is a rear plan view of one embodiment of the invention.

Referring now to FIGS. 1–5, a club head is generally referred to as numeral 10. The club head 10 is preferably cast metal having an integrally formed hosel portion 2, face portion 20, heel portion 5, toe portion 7, and flange portion 14. The hosel portion has one end for receiving a club shaft (not shown), while the other end is integral with one side of the club face. The opposite side of the club face is shown as numeral 4.

The weights 6, 8, 10 are provided opposite the face portion 20 and are receivable in integrally formed sockets 16. Each weight has a threaded outer surface 22 and a headed portion 26. Each bore 18 is tapped to provide threads engageable with the threads of the weights. The intermeshing threads provide fastening means for fastening the weights within the bores. Preferably, the headed portion is provided with a groove 24 that facilitates insertion and removal of the weights. The groove may have a width corresponding to a coin, such as a quarter or dime, such that the weights can be removed and inserted without special tools. The depth may be curved to correspond to a portion of the coin used to remove or insert the weights.

Figure 2:
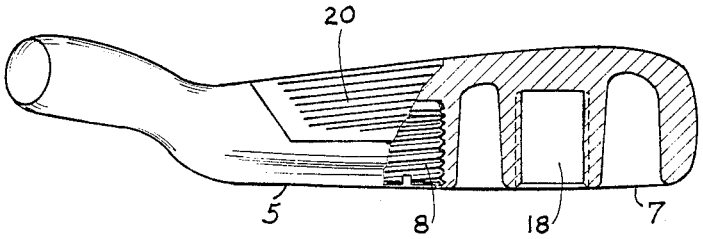
FIG. 2 is a top plan view, partly in section, of the embodiment of FIG. 1.
Figure 3:
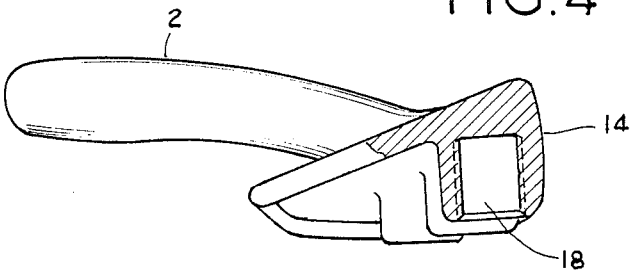
FIG. 3 is a side plan view, partly in section, of the embodiment of FIG. 1.

FIGS. 1–3 show an embodiment preferred for irons, in which the sockets 16 are disposed opposite the face portion 20 and show the flange portion 14. The area between the sockets 16 is hollowed out, as well as the area 21 above the sockets up to the upper edge 23 of the club head. The effect is to focus weight in the area of the sockets in order to increase force at the point of impact while broadening the sweet spot.

Figure 4:
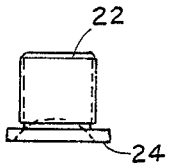
FIGS. 4 and 5 are side views of two weights used in all embodiments of the invention.
Figure 5:
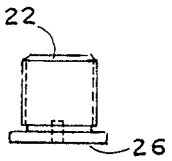

Weights shown in FIGS. 4 and 5 are of different density to illustrate how the invention works. While having different density, the weights have the same diameters and thread patterns so that they are completely interchangeable.

For irons, the sockets preferably have an outer peripheral edge coextensive with an edge of flange 14, and have longitudinal axes aligned with the direction of the swing. In other emdodiments, the socket positions are different.

Figure 6:
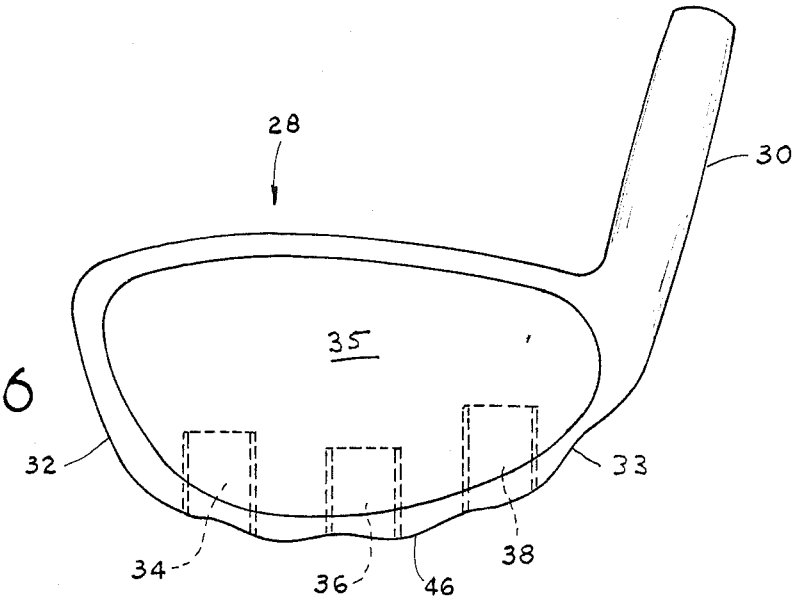
FIG. 6 is a front plan view of another embodiment of the invention.
Figure 7:
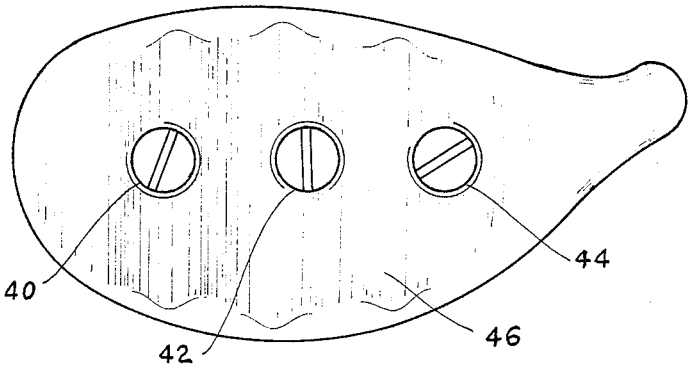
FIG. 7 is a bottom plan view of the embodiment of FIG. 6.

FIGS. 6 and 7 relate to an embodiment preferred for woods. The club head, generally referred to as 28, has a hosel portion 30, a flange or bottom 46, toe portion 32, heel portion 33 and face portion 35. Sockets 34, 36, 38 extend upwardly from the bottom into the club head, which may be made of wood or metal. Preferably, socket 36 is located at the point of impact where the ball meets the face, as in the other embodiment. Weights 40, 42, 44 are secured in the bores of the sockets by threads or other suitable means.

Figure 8:
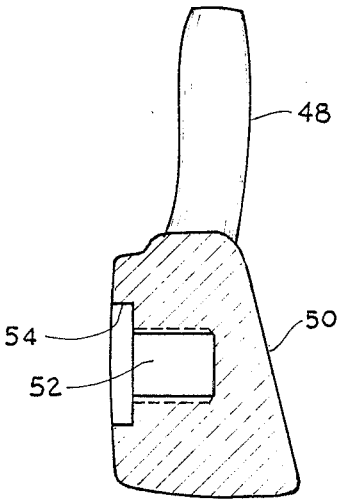
FIG. 8 is a side plan view, partly in section of another embodiment of the invention.
Figure 9:
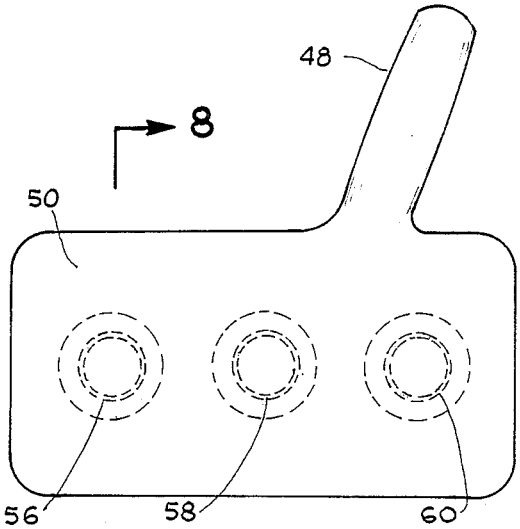
FIG. 9 is a front plan view of the embodiment of FIG. 8.

FIGS. 8 and 9 show another embodiment of the invention for putters. The sockets are generally disposed in the same direction as in the irons, but are elevated or spaced above the flange. Again, the putter has a hosel portion 48 and a face portion 50. The face is substantially vertical and the weights 52 having countersunk headed portions 54 are disposed approximately at a longitudinal axis of the club face in bores 56, 58, 60.

While the present invention has been described with respect to specific embodiments, modifications may be made without departing from the scope of the invention.

I claim:

1. A golf club head for attachment to a shaft comprising an integrally formed hosel, heel, toe, ball striking face and a lower flange extending rearward from said face a distance substantially greater than the thickness of the upper portion of said head, three internally threaded sockets extending rearwardly and horizontally along parallel axes along the lower portion of the club head adjacent said flange, and at least one set of removable and interchangeable threaded weights receivable in said three threaded sockets, the back of the club head opposite said face and above said flange being hollowed, and portions of said head between said sockets being hollowed, so that the center of gravity of the club head is lowered.

2. The apparatus of claim 1 wherein the weights comprise plural sets of weights, each set being made of a material having a density different from the material of the others sets.

3. The apparatus of claim 2 wherein the material used in fabricating each set of weights is selected from a group consisting of brass, plastic, steel, stainless steel, lead, wood and copper.

* * * * *